United States Patent [19]

Brotman

[11] Patent Number: 5,040,787

[45] Date of Patent: Aug. 20, 1991

[54] AUXILIARY MAGNETIC WEIGHTS

[76] Inventor: Eric M. Brotman, Box 1061, Nevada City, Calif. 95959

[21] Appl. No.: 471,421

[22] Filed: Jan. 29, 1990

Related U.S. Application Data

[63] Continuation of Ser. No. 306,894, Feb. 6, 1989, abandoned.

[51] Int. Cl.[5] ..... A63B 21/075

[52] U.S. Cl. ..... 272/123; 272/117

[58] Field of Search ..... 272/117, 118, 119, 122, 272/123, 124, 143; 24/31 V, 289, 303, 306; 128/DIG. 15

[56] References Cited

U.S. PATENT DOCUMENTS

| | | | |
|---|---|---|---|
| 272,144 | 2/1883 | McGinnis | 272/122 X |
| 3,171,652 | 3/1965 | Newman | 272/123 |
| 3,254,440 | 6/1966 | Duggar | 24/303 X |
| 4,250,596 | 2/1981 | Hara et al. | 24/289 |
| 4,382,302 | 5/1983 | Watson | 272/119 X |
| 4,432,504 | 2/1984 | Pace | 24/31 V X |
| 4,576,150 | 3/1986 | Auracher | 128/DIG. 15 X |
| 4,632,389 | 12/1986 | Moss | 272/119 |
| 4,693,921 | 9/1987 | Billarant et al. | 24/306 X |
| 4,712,793 | 12/1987 | Harwick et al. | 272/118 |
| 4,787,628 | 11/1988 | Harwick et al. | 272/118 |

*Primary Examiner*—Robert Bahr

*Attorney, Agent, or Firm*—Townsend & Townsend

[57] ABSTRACT

An auxiliary weight system comprising a plurality of auxiliary weights of intermediate values. The auxiliary weights have magnets for releasably attaching the auxiliary weights to substantially any desired exercising device to permit variation of the weights employed by such device in substantially any desired manner.

1 Claim, 1 Drawing Sheet

AUXILIARY MAGNETIC WEIGHTS

RELATED CASES

This invention is a Continuation of my copending patent application, Serial No. 306,894, filed Feb. 6, 1989, and now abandoned.

BACKGROUND

1. Field of the Invention

This invention relates to exercise equipment and is particularly directed to auxiliary weights which may be attached magnetically to exercise equipment to provide temporary variation of the weights employed by such equipment for stressing the muscles of a person using such equipment.

2. Prior Art

Most types of exercise equipment employ weights which are lifted or moved, either directly or by respective mechanisms, to stress the muscles of a person using the equipment and, hence, to aid in maintaining or improving muscle tone and quality. Typically, such weights are found in dumbbells or barbells or in the so-called "machine stack weights". In most gymnasiums or health clubs, the dumbbells and barbells are stored on racks and are available in fixed five pound weight increments, i.e. 5 lb., 10 lb., 15 lb. etc. Similarly, the weights of the machine stack weights are built into the machines and are usually provided in fixed ten pound weight increments. In each case, the weight increments are fixed or "locked"; that is, they cannot be adjusted in any way to alter the weight increments. This is because impracticalities of space, economy or structural design have discouraged manufacturers from providing smaller weight increments. Unfortunately, the biomechanical limitations of many people who exercise predispose them to excessive strain and possible injury when using the previously available equipment. Thus, for a women or lightly built man to progress from a 15 pound pair of dumbbells to a 20 pound pair of dumbbells represents a 33% increase in workload. It would, obviously, be preferable to progress more gradually. However, with the exercise equipment of the prior art, such gradual increase has been possible only with certain very limited types of equipment.

A search in the United States Patent Office has revealed the following references:

| U.S. Pat. No. | INVENTOR | ISSUED |
|---|---|---|
| 3,758,109 | M. Bender | Sep. 11, 1973 |
| 4,453,710 | E. Plotz | June 12, 1984 |
| 4,531,728 | G. L. Wright | July 30, 1985 |
| 4,712,793 | M. C. Harwick et al | Dec. 15, 1987 |

Each of the reference patents discloses exercise equipment having auxiliary weights to permit gradual weight increases. Unfortunately, each of the reference devices provides auxiliary weights which are useful only with the specific equipment for which they were designed. This significantly increases the cost of the equipment and yet provides only limited additional utility. To fully equip a gym or health club with such equipment would be prohibitively expensive and still would not permit gradual weight increases for dumbbells, barbells and the like. Thus none of the prior art auxiliary weight systems have been entirely satisfactory.

BRIEF SUMMARY AND OBJECTS OF INVENTION

These disadvantages of the prior art are overcome with the present invention and an auxiliary weight system is provided which is simple and inexpensive to produce, requires little or no maintenance and yet is readily applicable to virtually any and all exercise equipment without alteration or modification of such equipment.

The advantages of the present invention are preferably attained by providing an auxiliary weight system comprising a plurality of auxiliary weights of intermediate values having magnetic means for releasably attaching the auxiliary weights to substantially any desired exercising device to permit variation of the weights employed by such device in substantially any desired manner.

Accordingly, it is an object of the present invention to provide improved weights for exercising equipment.

Another object of the present invention is to provide improved auxiliary weights for exercise equipment which are releasably attachable to substantially any desired exercise device.

An additional object of the present invention is to provide auxiliary weights for exercise equipment which permit variation of the weights employed in such equipment substantially as desired.

A further object of the present invention is to provide auxiliary weights for exercise equipment which are releasably attachable to permit gradual variation of the weights employed by such equipment.

A specific object of the present invention is to provide an auxiliary weight system comprising a plurality of auxiliary weights of intermediate values having magnetic means for releasably attaching the auxiliary weights to substantially any desired exercising device to permit variation of the weights employed by such device in substantially any desired manner.

These and other objects and features of the present invention will be apparent from the following detailed description, taken with reference to the figures of the accompanying drawings.

DETAILED DESCRIPTION OF THE INVENTION

Figure 1:
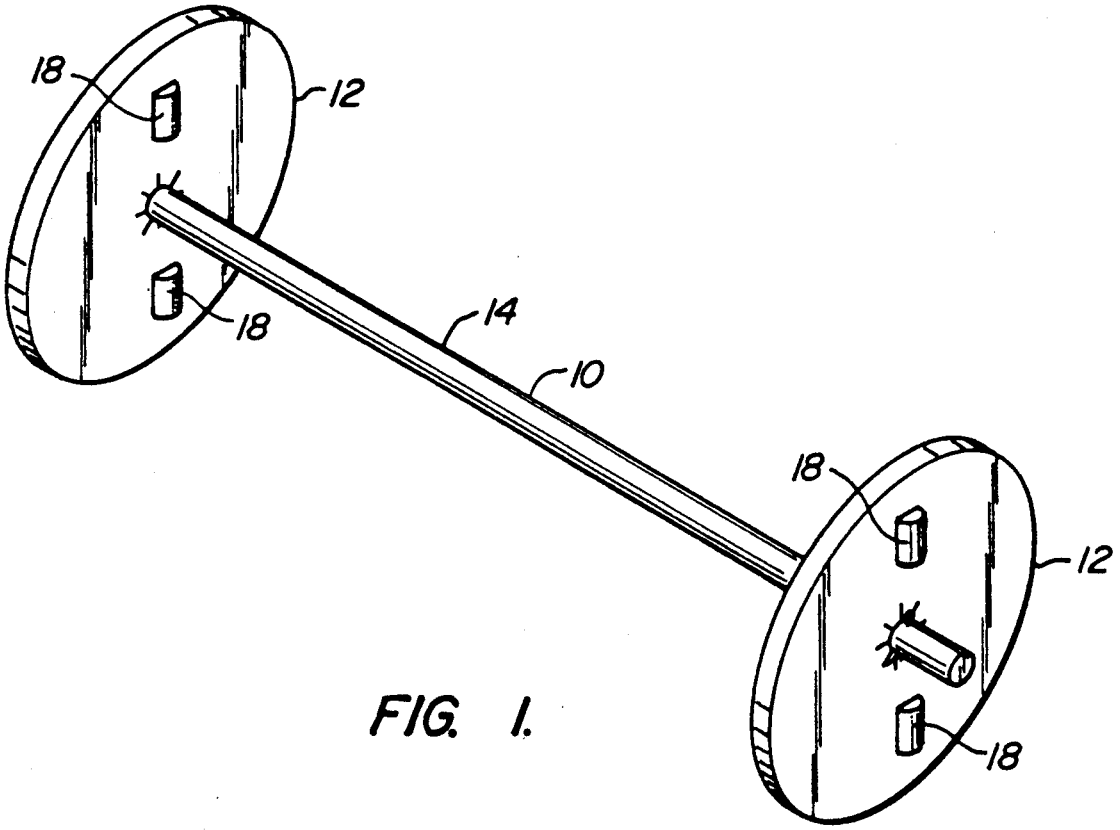
FIG. 1 is an isometric view of a dumbbell employing an auxiliary weight embodying the present invention.
Figure 2:
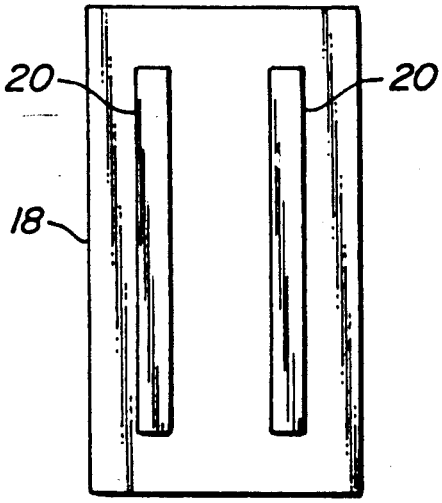
FIG. 2 is a front view of an auxiliary weight of FIG. 1.
Figure 3:
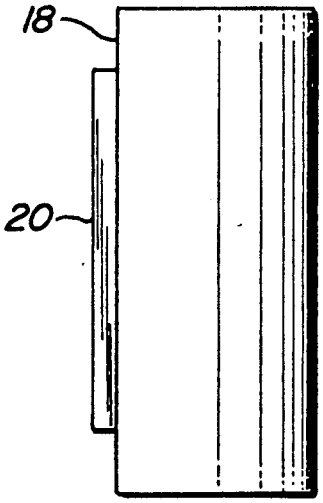
FIG. 3 is a side view of the auxiliary weight of FIG. 1.

In that form of the present invention chosen for purposes of illustration in the drawings, FIG. 1 shows a dumbbell, indicated generally at 10, comprising a pair of weights 12 fixedly mounted on a crossbar 14. As indicated above, the weights 12 are conventionally supplied in fixed five pound increments, which may be excessive for some individuals. Thus, in accordance with the present invention, auxiliary weights 18 are provided having magnets 20 embedded therein to permit the auxiliary weights 18 to be releasably attached to the weights 12 of the dumbbell 10. The auxiliary weights 18 are preferably provided in increments of ¼ lb., ½ lb., 1 lb., 2 lb, 3 lb. 4 lb. and 5 lb. Furthermore, if desired, two or more of the auxiliary weights 18 may be mounted on the weights 12 of the dumbbell 10, as seen in FIG. 1. Thus, the weight provided by the dumbbell 10 can be varied substantially as desired. As seen in FIGS. 2 and 3, the auxiliary weights 18 are formed generally in the shape of a flat-sided cylinder or bar and have a pair of elongated bar magnets 20 embedded in one surface 22 of the weight 18 and protruding slightly from the surface 22, as best seen in FIG. 3.

In use, a plurality of the auxiliary weights 18 are provided in a range of weight values intermediate the standard "fixed" weight values of the exercise equipment. When it is desired to alter the weight of a particular exercising device, such as the barbell 10 of FIG. 1, one or more of the auxiliary weights 18 is selected to provide the desired weight variation and these auxiliary weights 18 are attached to the desired exercising device by placing the magnets 20 of the auxiliary weights 18 in proximity with the weights of the exercising device and allowing the magnets 20 to magnetically adhere to the weights of the exercising device. This will increase the effective weight of the desired exercising device by the desired amount and the user can proceed to exercise without fear of exceeding their abilities. As the user's strength increases, additional auxiliary weights 18 can be employed or heavier auxiliary weights 18 can by substituted until the user is able to advance to the next heavier "fixed" weight. Furthermore, although the auxiliary weight system of the present invention has been described above and shown in the accompanying drawings as applied to a dumbbell, it will be apparent that, if desired, the auxiliary weights 18 could be releasably attached to the weights of a barbell, machine stack device or substantially any other type of exercise device with equal ease.

In addition, numerous variations and modification can, obviously, be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. In combination with free weight exercise apparatus of the type including a plurality of generally disk-shaped weighted members of fixed weight values, each said weighted member presenting a generally vertical surface during use, said vertical surface having a portion subject to magnetic attraction, a plurality of incremental weights wherein each said incremental weight includes a magnet and a surface formed for engagement with said generally vertical surface, wherein the incremental weight of said plurality have a series of weight values beginning with a fraction of the smallest of said fixed weight value, and wherein each said magnet has a magnetic strength sufficient to maintain the respective incremental weight in engagement with said generally vertical surface during the movement encountered during use of said free weight exercise apparatus.

* * * * *